US008414738B2

(12) United States Patent
Rekoske et al.

(10) Patent No.: US 8,414,738 B2
(45) Date of Patent: Apr. 9, 2013

(54) MULTIPLE PLY PAPER PRODUCT WITH IMPROVED PLY ATTACHMENT AND ENVIRONMENTAL SUSTAINABILITY

(75) Inventors: Michael John Rekoske, Appleton, WI (US); Thomas G. Neal, Jr., Appleton, WI (US); Nicholas A. Kraft, Appleton, WI (US); Benjamin Joseph Kruchoski, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 499 days.

(21) Appl. No.: 11/847,440

(22) Filed: Aug. 30, 2007

(65) Prior Publication Data

US 2009/0056892 A1 Mar. 5, 2009

(51) Int. Cl.

*D21H 27/30* (2006.01)
*D21H 27/38* (2006.01)
*B32B 29/00* (2006.01)

(52) U.S. Cl.

USPC ..... 162/129; 162/117; 162/132; 162/147; 162/205; 428/156; 428/172

(58) Field of Classification Search ..... 162/109, 162/117, 123–125, 129–133, 141–142, 147, 162/149, 204–205; 428/156, 172

See application file for complete search history.

(56) References Cited

U.S. PATENT DOCUMENTS

| | | | | | |
|---|---|---|---|---|---|
| 3,940,529 | A | | 2/1976 | Hepford et al. | |
| 4,100,017 | A | | 7/1978 | Flautt | |
| 5,397,435 | A | * | 3/1995 | Ostendorf et al. | 162/112 |
| 5,405,501 | A | * | 4/1995 | Phan et al. | 162/127 |
| 5,437,766 | A | * | 8/1995 | Van Phan et al. | 162/127 |
| 5,494,554 | A | | 2/1996 | Edwards et al. | |
| 5,573,637 | A | * | 11/1996 | Ampulski et al. | 162/112 |
| 5,830,317 | A | * | 11/1998 | Vinson et al. | 162/125 |
| 5,981,044 | A | * | 11/1999 | Phan et al. | 428/212 |
| 6,027,611 | A | | 2/2000 | McFarland et al. | |
| 6,136,422 | A | | 10/2000 | Lichtenberg et al. | |
| 6,440,267 | B1 | | 8/2002 | Rekoske et al. | |
| 6,544,386 | B1 | * | 4/2003 | Krzysik et al. | 162/123 |
| 6,669,814 | B2 | * | 12/2003 | Hansen et al. | 162/129 |
| 6,709,550 | B2 | * | 3/2004 | Holz et al. | 162/130 |
| 6,755,937 | B1 | | 6/2004 | Baggot et al. | |
| 6,797,114 | B2 | | 9/2004 | Hu | |
| 6,797,117 | B1 | * | 9/2004 | McKay et al. | 162/158 |
| 6,833,055 | B2 | * | 12/2004 | Hansen et al. | 162/129 |
| 6,841,038 | B2 | * | 1/2005 | Horenziak et al. | 162/129 |
| 6,855,229 | B2 | * | 2/2005 | McKay et al. | 162/179 |
| 6,861,380 | B2 | * | 3/2005 | Garnier et al. | 442/413 |
| 6,887,350 | B2 | * | 5/2005 | Garnier et al. | 162/135 |
| 6,964,725 | B2 | | 11/2005 | Shannon et al. | |
| 6,998,017 | B2 | | 2/2006 | Lindsay et al. | |
| 7,029,756 | B2 | | 4/2006 | Moline et al. | |
| 7,147,752 | B2 | | 12/2006 | Shannon et al. | |
| 7,524,399 | B2 | * | 4/2009 | Hermans et al. | 162/123 |
| 7,622,020 | B2 | * | 11/2009 | Awofeso et al. | 162/111 |
| 7,678,230 | B2 | * | 3/2010 | Shannon et al. | 162/129 |
| 2004/0112558 | A1 | * | 6/2004 | Garnier et al. | 162/129 |
| 2004/0144511 | A1 | * | 7/2004 | McKay et al. | 162/158 |
| 2004/0188045 | A1 | * | 9/2004 | McKay et al. | 162/158 |
| 2005/0224201 | A1 | | 10/2005 | Anderson et al. | |
| 2006/0130988 | A1 | * | 6/2006 | Hermans et al. | 162/123 |
| 2007/0298221 | A1 | * | 12/2007 | Vinson | 428/154 |
| 2008/0216977 | A1 | * | 9/2008 | Dyer et al. | 162/112 |
| 2009/0056892 | A1 | * | 3/2009 | Rekoske et al. | 162/111 |
| 2010/0043989 | A1 | * | 2/2010 | Shannon et al. | 162/112 |

FOREIGN PATENT DOCUMENTS

| | | | | |
|---|---|---|---|---|
| EP | 631014 | A1 | * | 12/1994 |
| GB | 294480 | A | * | 5/1996 |
| GB | 2304123 | A | * | 3/1997 |
| WO | WO 0147699 | A1 | * | 7/2001 |
| WO | WO 2005031068 | A1 | * | 4/2005 |

* cited by examiner

*Primary Examiner* — Jose A Fortuna
(74) *Attorney, Agent, or Firm* — Dority & Manning, P.A.

(57) ABSTRACT

The present disclosure is generally directed to a multiple ply tissue product that includes a first ply and a second ply. The first ply includes a first outwardly facing layer having hardwood fibers, a second layer having softwood fibers, and a third layer having at least about 10 percent by weight post-consumer recycled fiber, wherein the second layer is positioned between the first layer and the third layer.

17 Claims, 2 Drawing Sheets

MULTIPLE PLY PAPER PRODUCT WITH IMPROVED PLY ATTACHMENT AND ENVIRONMENTAL SUSTAINABILITY

BACKGROUND

Softness has always been a significant property in multiple ply paper products. Products made from paper webs such as bath tissues, facial tissues, paper towels, industrial wipers, food service wipers, napkins, medical pads and other similar products are designed to have a relatively soft feel through the use of softening chemicals. However, with the use softening chemicals it has become more difficult to maintain acceptable levels of ply attachment. Furthermore, while softness is of importance, environmental sustainability is also rapidly becoming a desired feature in consumer products.

For paper products, a component of an environmentally sustainable product is the use of recycled fiber. Although a high level of recycled fiber is desirable from an environmental viewpoint, the incorporation of recycled fiber, particularly post-consumer recycled fiber, can create significant problems in the properties of the end product.

As such, a need exists for paper products containing high levels of recycled fiber, particularly post-consumer recycled fiber, which also have performance attributes that are preferable relative to products that do not contain high levels of recycled fiber and wherein, the improved performance benefits of such products is due to the properties imparted by the recycled fiber.

SUMMARY

The present disclosure is directed to tissue products having enhanced environmental sustainability while providing consumer preferred benefits with regard to overall product attributes currently valued by consumers. In this regard, the present disclosure is directed to a fiber layering approach which allows for the inclusion of post-consumer recycled fiber without negatively impacting the softness properties of the tissue product while at the same time achieving improvement in the ply attachment of the product. Objects and advantages of the disclosure will be set forth in part in the following description, or may be obvious from the description, or may be learned through the practice of the disclosure.

The present disclosure is generally directed to a multiple ply tissue product that includes a first ply and a second ply. The first ply includes a first outwardly facing layer having hardwood fibers, a second layer having softwood fibers, and a third layer having at least about 10 percent by weight post-consumer recycled fiber, wherein the second layer is positioned between the first layer and the third layer.

In certain embodiments, the third layer may comprise at least about 15% by weight post-consumer recycled fiber. The third layer may comprise at least about 20% by weight post-consumer recycled fiber. The third layer may comprise at least about 25% by weight post-consumer recycled fiber. The third layer may comprise at least about 30% by weight post-consumer recycled fiber. The hardwood fibers may comprise eucalyptus fibers. The hardwood fibers may further comprise eucalyptus fibers pretreated with silicone. The softwood fibers may comprise northern softwood kraft fibers. The hardwood fibers may be present in an amount from about 30 percent to about 50 percent by weight. The softwood fibers may be present in an amount from about 20 percent to about 40 percent by weight. The product may include a second ply having a first layer having hardwood fibers, a second layer having softwood fibers, and a third layer having at least about 10 percent by weight post-consumer recycled fiber, wherein the second layer of the second ply is positioned between the first layer of the second ply and the third layer of the second ply. The third layer of the first ply may be positioned adjacent to the third layer of the second ply. The first ply and the second ply may be joined together by mechanical crimping.

In another exemplary embodiment, a multiple ply tissue product is disclosed which includes a first ply and a second ply. The first ply includes a first outwardly facing layer having hardwood fibers, a second layer having softwood fibers, and a third layer having at least about 10 percent by weight post-consumer recycled fiber, wherein the second layer is positioned between the first layer and the third layer. The second ply includes a first layer having hardwood fibers, a second layer having softwood fibers, and a third layer having at least about 10 percent by weight post-consumer recycled fiber, wherein the second layer of the second ply is positioned between the first layer of the second ply and the third layer of the second ply.

Other features and aspects of the present disclosure are discussed in greater detail below.

BRIEF DESCRIPTION OF THE DRAWINGS

A full and enabling disclosure of the present disclosure, including the best mode thereof to one of ordinary skill in the art, is set forth more particularly in the specification, including reference to the accompanying Figures in which.

DETAILED DESCRIPTION

Figure 1:
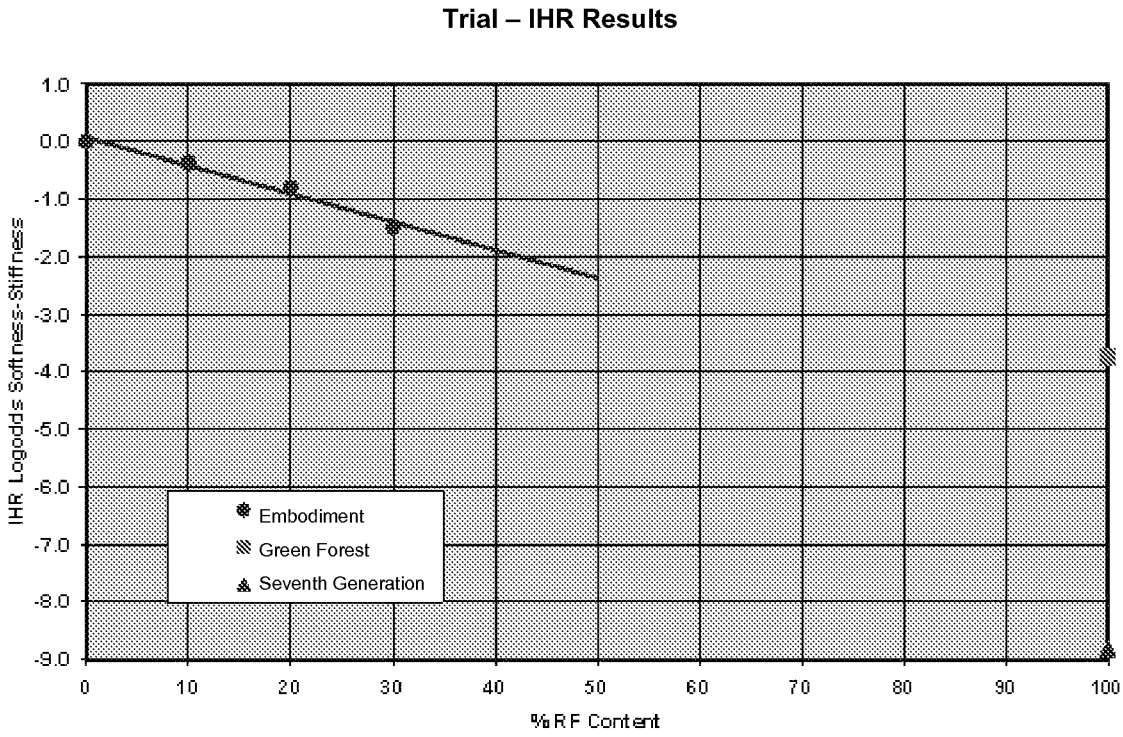
FIG. 1 is a plot of IHR logodds Softness-Stiffness versus % post-consumer recycled content in accordance with one embodiment of the present disclosure.

It is to be understood by one of ordinary skill in the art that the present discussion is a description of exemplary embodiments only, and is not intended as limiting the broader aspects of the present disclosure, which broader aspects are embodied in the exemplary construction.

The present disclosure is generally directed to a multiple ply paper product and methods for making the same. In particular, the present disclosure is applicable to multiple ply paper products containing recycled fiber. The multiple ply paper products of the present disclosure are made by combining at least three layers. In this regard, the terms "ply" and "web" are used interchangeably throughout the present disclosure. In certain embodiments, a first ply can include a layer having hardwood fiber, a layer having softwood fiber, and a layer having high levels of post-consumer recycled fiber. Similarly, a second ply can include a layer having hardwood fiber, a layer having softwood fiber, and a layer having high levels of post-consumer recycled fiber.

Paper products as described in this disclosure are meant to include paper products made from base webs such as bath tissues, facial tissues, paper towels, industrial wipers, food-service wipers, napkins, medical pads, and other similar products.

Tissue products can be differentiated from other paper products in terms of their bulk. The bulk of the tissue products of the present disclosure may be calculated as the quotient of the caliper expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present disclosure which tend to have much higher calipers for a given basis weight. The multiple ply tissue products of the present disclosure have a bulk that can range between about 2 $cm^3/g$ to about 20 $cm^3/g$, more specifically between about 3 $cm^3/g$ to about 20 $cm^3/g$, and still more specifically between about 4 $cm^3/g$ to about 18 $cm^3/g$.

The bulk of the individual sheets making up the multiple ply product may or may not be the same, however, each of the individual sheets making up the multiply tissue product will have a bulk greater than about 2 cubic centimeters per gram or greater and more specifically from about 3 cubic centimeters per gram to about 24 cubic centimeters per gram, more specifically from about 4 cubic centimeters per gram to about 16 cubic centimeters per gram.

Single sheet bulk is calculated by taking the single sheet caliper and dividing by the conditioned basis weight of the product. The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up.

Caliper is expressed in microns. Caliper is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals.) For the multiple ply products of the present disclosure the single sheet bulk is determined by deplying the sheets before measuring the caliper and basis weight as defined.

The basis weight and bone dry basis weight of the tissue sheet specimens are determined using TAPPI T410 procedure or a modified equivalent such as: Tissue samples are conditioned at 23° C.±1° C. and 50±2% relative humidity for a minimum of 4 hours. After conditioning a stack of 16–3"×3" samples is cut using a die press and associated die. This represents a tissue sheet sample area of 144 $in^2$ or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram on a tared analytical balance. The basis weight in grams per square meter is calculated using the following equation:

$$\text{Basis weight} = \text{stack wt. in grams}/0.0929$$

The Crimp Strength is obtained by using the Crimp Strength Test for Ply Attachment Standard Test Procedure (STP) 814-W. This test is used to determine the ply attachment strength by measuring the force in grams required to pull apart individual plies at the crimp lines in a multi-ply product. The test clamps one side of the specimen on a lower moving platen and clamps the ply to be separated during the test in a load cell. The specimen is pulled apart in a 180 degree peel by moving the platen to the left while the force required when pulling the crimping bonds apart is measured by the load cell.

The following materials can be utilized: Slip/Peel Tester, IMASS SP-2000 with a MB-5 five pound force transducer available from Instrumentors, Inc. having an office at 22077 Drake Rd. Strongsville, Ohio 44149 and marketed by Imass, Inc. having an office at Box 134, Accord, Mass. 02018; a platen clamp having the capability to secure the test specimen to the moving platen without slippage; a specimen clamp having the capability to secure the test specimen to the load cell without slippage. The platen clamp and the specimen clamp should be at least as long as the test specimen to ensure the specimen does not rip during testing.

The platen clamp can be constructed from a plastic bar approximately 1 inch in width having two holes and secured to the moving platen by two thumb screws. The specimen clamp can be constructed by cutting a C-Thru Ruler Company ruler, part number W30 or equivalent, into two pieces at least four inches in length. Apply Tesa Tape, Inc. anti-slip tape, part number 4563, or equivalent, to one side of each ruler section. Place the two ruler pieces with the anti-slip surfaces on a table facing down, align the two ruler sections and butt the long edges together. Apply filament tape, 3M part number 898, or equivalent, to the seam between the two ruler pieces to form a living hinge by extending the tape approximately one-half an inch over each ruler piece. Remove the ruler sections from the table and fold in half along the tape seam such that the anti-slip surfaces face each other.

In order to prepare the test specimens, cut the multi-ply web into a square 4±0.25 inches by 4±0.25 inches (100±6 mm). The crimping line should be parallel to one edge of the test specimen having a narrow amount of material to one side of the crimping line and a wider section of material to the other side of the crimping line. For facial tissue multiple ply webs avoid the ends of the sample and cut a four inch wide CD strip from the middle of the sheet and then cut four inches in from each MD edge of the sheet to form the test rectangular test specimens.

To test the specimens, conduct the testing in an atmosphere of 23°±1° C. and 50±2% relative humidity. Condition all specimens a minimum of 24 hours prior to testing. Turn on the Slip/Peel tester and wait 15 minutes. At the MAIN SCREEN press OK and at the LOAD CELL LIMIT screen press OK. Insert the specimen clamp into the load cell clamp and calibrate and balance the load cell by pressing the BAL (& CAL) button. Press and hold the RETN button until the platen stops moving. At the TEST CONDITIONS screen verify that the screen shows the following: PEEL, 2 Kg cell force g., 1 sec dly, 2.43 in, 5 sec avg, time, 28.0 in/min. Press OK. At the READY TO TEST screen, the return position 0.00 in. is displayed. If necessary, perform the four-point verification before simultaneously pressing and holding the JOG and TEST buttons to move the platen approximately 2.5 inches to the left. Use the MANUAL POSITIONING knob to move the platen until the display reads exactly 2.50 inches. Remove the specimen clip from the load cell clamp.

Separate the plies of the test specimen opposite the crimp line without placing any strain on the crimp line. For a three-ply specimen, ten (10) samples should be prepared. Ten (10) additional specimens should also be prepared. Place the single outer ply in the specimen clip and attach the remaining plies of the specimen to the moving platen with the platen clamp. Ensure that the specimen is placed squarely into the Slip/Peel tester with the crimp line is perpendicular to the front edge of the moving platen. Use the MANUAL POSITIONING knob to move the platen to the right or left to eliminate excessive slack or preload after the specimen has been clamped in place. Press TEST and the platen will stop after 5.1 seconds. Read and record the kinetic peak (KP) to the nearest 0.1 gram. Remove the test specimen and press the RETN button. Insert a new test specimen and repeat the testing sequence.

Results are calculated as follows: For a two-ply web or multi-ply web, test at least ten (10) specimens and average the results to obtain the Ply Attachment Strength for separating each ply from any other ply in the multi-ply web. For a three-ply web, test at least ten (10) specimens by measuring the force it takes to remove the ply from the other plies. Average the results to obtain the First-Side Ply Attachment Strength. Then test at least ten (10) specimens by measuring the force it takes to remove a ply 40 from the other plies. Average the results to obtain the Second-Side Ply Attachment Strength. Divide the First-Side Ply Attachment Strength by the Second-Side Ply Attachment Strength to obtain the Strength Ratio of the First-Side to the Second-Side. If there is no variation in crimp bond strength from one side to the other side, the Strength Ratio of the First-Side to the Second-Side will have a value of 1.0.

Softness is determined using an in hand ranking test (IHR). Panelists received samples and were asked to rank them for softness based upon subjective criteria. Specifically, the panelists received different sets of samples several times. Each sample was coded. Replicates were compared in order to estimate error. The panelists response data was modeled with Logistic Regression to determine paired scores and log odds.

As stated previously, the product of the present disclosure is formed by combining at least three different layers to form a ply. In certain embodiments, a first layer can include hardwood fiber, a second layer can include softwood fiber, and a third layer can include high levels of post-consumer recycled fiber with the second layer positioned between the first layer and the third layer. Two or more plies can be combined to form the multiple ply paper product of the present disclosure. The basis weight, calipers and bulk of the plies can be the same or different as would be understood by one of ordinary skill in the art.

In this regard, it has been determined that through the fiber layering approach of the present disclosure, it is possible to include post-consumer recycled fiber in the multiple ply paper product without negatively impacting the softness properties of the product while actually improving the ply attachment of the product.

For instance, in certain embodiments of the present disclosure, two or more plies can be joined together such that adjacent layers of each ply include high levels of post-consumer recycled fiber. In certain embodiments, exterior outwardly facing layers of the multiple ply paper product of the present disclosure can include hardwood fiber.

In certain embodiments, the multiple ply paper product of the present disclosure has a crimp strength of at least about 20 grams. In certain embodiments, the multiple ply paper product of the present disclosure has a crimp strength of at least about 30 grams. In certain embodiments, the multiple ply paper product of the present disclosure has a crimp strength of at least about 40 grams.

As described herein, it is possible to include post-consumer recycled fiber in the multiple ply paper product of the present disclosure without negatively impacting various properties of the product. Post-consumer recycled fiber is sourced from end products generated by consumers where such end products have been separated or diverted from the solid waste stream. Examples of post-consumer recycled fiber can include, without limitation, office wastepaper, junk mail, magazines, undeliverable mail, shipping packaging, and the like. Pre-consumer recycled fiber is sourced from materials that have not met their intended end-use by a consumer. Examples of such materials can include, without limitation, manufacturing waste, mill scraps, pre-consumer deinking material, pulp substitutes, and the like. Pre-consumer recycled fiber does not, however, include mill broke defined as paper or paperboard scrap generated in a mill prior to completion of the manufacturing process which is unsuitable for subsequent applications but can be utilized in the paper manufacturing process.

In certain embodiments, a ply in accordance with the present disclosure can include at least one layer with at least about 10% by weight post-consumer recycled fiber. As used herein, percent (%) by weight is the weight of fibrous material divided by the total weight of material in a ply multiplied by 100. In other embodiments, a ply can include a layer with at least about 15% by weight post-consumer recycled fiber. In still other embodiments, a ply can include a layer with at least about 20% by weight post-consumer recycled fiber. In still other embodiments, a ply can include a layer with at least about 25% by weight post-consumer recycled fiber. In still other embodiments, a ply can include a layer with at least about 30% by weight post-consumer recycled fiber.

In some embodiments, a layer of a ply of the multiple ply paper product of the present disclosure can include hardwood fiber. The hardwood fiber of can be present in a layer in an amount from about 30% to about 50% by weight. In certain embodiments, a layer that includes hardwood fiber can form an exterior surface of a ply of the multiple ply paper product of the present disclosure.

In some embodiments, a layer of a ply of the multiple ply paper product of the present disclosure can include softwood fiber. The softwood fiber of the can be present in a layer in an amount from about 20% to about 40% by weight. In certain embodiments, a layer that includes softwood fiber can form an interior layer of a ply of the multiple ply paper product of the present disclosure.

The product of the present disclosure can be made available to the consumer in a rolled, folded or sheet form as well known in the art. In another embodiment, a visual or cue is provided in the product to enable the consumer to distinguish said first and second sides of said multiple ply product. Said cue may consist of a coloration difference, a printing difference, embossing difference or any other means well known in the art. The means by which the webs are attached to each other is not overly critical to the disclosure and may be done by any means known in the art, including but not limited to pin embossing, crimping, glue nested embossing and the like.

An important property of the multiple ply paper product of the present disclosure is softness. The product of the present disclosure can have both a high level of post-consumer recycled fiber yet retains its softness as well as a value added benefit of increased hand protection.

It should be appreciated that variations in the process for producing the multiple ply paper product of the present disclosure can be made without departing from the scope and spirit of the disclosure. A preferred process for producing the multiple ply paper product of the present disclosure is a conventional wet-pressed and creped tissue process. Such a process is described in U.S. Pat. No. 5,494,554 to Edwards et al. which is herein incorporated by reference.

Once creped, the sheet can pulled through an optional drying station. The drying station can include any form of a heating unit, such as an oven energized by infrared heat, microwave energy, hot air or the like. Alternatively, the drying station may comprise other drying methods such as photo-curing, UV-curing, corona discharge treatment, electron beam curing, curing with reactive gas, curing with heated air such as through-air heating or impingement jet heating, infrared heating, contact heating, inductive heating, microwave or RF heating, and the like. The drying station may be necessary in some applications to dry the sheet and/or cure the flexible polymeric binder material materials. Depending upon the flexible polymeric binder material selected, however, a drying station may not be needed. Once passed through the drying station, the sheet can be wound into a roll of material.

In certain embodiments, two or more webs may be mechanically attached together by crimping. Crimping is a process frequently used to attach individual webs or plies to one another to form a multiple ply product. Crimping involves placing the multiple ply web in the nip between an anvil roll and a crimping roll. The rolls are then loaded together during rotation such that the protuberances on the crimping roll crush or indent the individual plies of the multiple ply web resulting in mechanically induced bonds that hold the webs together.

Besides the above method for joining the webs, it should be understood that any suitable manner for joining two or more webs together can be used in the present disclosure. For example, various methods for attaching webs together are disclosed in U.S. Pat. No. 3,940,529 to Hepford et al., U.S. Pat. No. 4,100,017 to Flauft, and U.S. Pat. No. 6,136,422 to Lichtenberg, et al., which are all incorporated herein by reference.

In addition, three or more webs can be joined together using the above-described methods. It should also be understood that regardless of the method selected for joining two or more webs together, the webs can be joined together in specific locations. For instance, the webs can be joined only in the MD direction on the outer edges of the webs so as to form a pocket suitable to cover the hand of a wearer or an apparatus which the product covers. Preferably, a means to discern the two sides of the product is provided such that a consumer is readily informed as to which side of the product to use first.

Generally, a wide variety of natural and synthetic pulp fiber are suitable for use in the multiple ply products of this disclosure. The pulp fiber may include fiber formed by a variety of pulping processes, such as kraft pulp, sulfite pulp, thermomechanical pulp, etc. In addition, the pulp fiber may consist of any high-average fiber length pulp, low-average fiber length pulp, or mixtures of the same. One example of suitable high-average length pulp fiber includes softwood fiber. Softwood pulp fiber is derived from coniferous trees and include pulp fiber such as, but not limited to, northern softwood, southern softwood, redwood, red cedar, hemlock, pine (e.g., southern pines), spruce (e.g., black spruce), combinations thereof, and the like. Northern softwood kraft pulp fiber may be used in the present disclosure. One example of commercially available northern softwood kraft pulp fiber suitable for use in the present disclosure include those available from Kimberly-Clark Corporation located in Neenah, Wis. under the trade designation of "Longlac-19". An example of suitable low-average length pulp fiber is the so called hardwood pulp fiber. Hardwood pulp fiber is derived from deciduous trees and include pulp fiber such as, but not limited to, eucalyptus, maple, birch, aspen, and the like. In certain instances, eucalyptus pulp fiber may be particularly desired to increase the softness of the web. Eucalyptus pulp fiber may also enhance the brightness, increase the opacity, and change the pore structure of the web to increase its wicking ability.

Optional chemical additives may also be added to the aqueous papermaking furnish or to one or more tissue sheets of the multiple ply paper products of the present disclosure to impart additional benefits to the product and process. Such chemicals may be added at any point in the papermaking process, such as before or after addition of the flexible polymeric binder material.

For example, debonding agents may be applied to the fiber in any or all plies of the sheet. Debonding agents useful for reducing the strength in the sheet(s) include any chemical that diminishes the capability of papermaking fiber to hydrogen bond together, thereby reducing the stiffness of the resulting sheet and increasing perceived softness. Any known in the art debonder can be used to reduce the strength of the sheet. Examples of such chemical debonders include quaternary ammonium compounds, mixtures of quaternary ammonium compounds with polyhydroxy compounds. Examples of quaternary ammonium compounds suitable for use in the present disclosure include dialkyldimethylammonium salts such as ditallow dimethyl ammonium chloride, ditallow dimethylammonium methyl sulfate, and di(hydrogenated)tallow dimethyl ammonium chloride. Particularly suitable debonding agents are 1-methyl-2 noroleyl-3 oleyl amidoethyl imidazolinium methyl sulfate and 1-ethyl-2 noroleyl-3 oleyl amidoethyl imidazolinium ethylsulfate. Suitable commercial chemical debonding agents include, without limitation, Degussa/Goldschmidt Varisoft 3696 and Hercules Prosoft TQ 1003. The debonding agent(s) can be applied anywhere in the process but is preferably applied to the fiber prior to forming the sheet.

Charge promoters and control agents, which are commonly used in the papermaking process to control the zeta potential of the papermaking furnish in the wet end of the process, can also be used. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Wet and dry strength agents may also be applied to the web. As used herein, "wet strength agents" refer to materials used to immobilize the bonds between fiber in the wet state. Any material that when added to a sheet results in providing the sheet with a mean wet geometric tensile strength:dry geometric tensile strength ratio in excess of about 0.1 is, for purposes of the present disclosure, termed a wet strength agent. Typically these materials are referred to as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50 percent of its original wet strength after exposure to water for a period of at least five minutes. Temporary wet strength agents are those which show about 50 percent or less of their original wet strength after being saturated with water for five minutes. Both classes of wet strength agents may find application for the tissue products of the present disclosure. If present, the amount of wet strength agent added to the pulp fiber can be about 0.1 dry weight percent or greater, more specifically about 0.2 dry weight percent or greater, and still more specifically from about 0.1 to about 3 dry weight percent, based on the dry weight of the fiber.

The temporary wet strength agents may be cationic, nonionic or anionic. Such compounds include, without limitation, PAREZ™ 631 NC and PAREZ® 725 temporary wet strength resins that are cationic glyoxylated polyacrylamide available from Kemira Chemicals, Inc., Kennesaw, Ga., Hercobond 1366, manufactured by Hercules, Inc., located at Wilmington, Del., is another commercially available cationic glyoxylated polyacrylamide that may be used in accordance with the present disclosure. Additional examples of temporary wet strength agents include dialdehyde starches such as Cobond® 1000 from National Starch and Chemical Company and other aldehyde containing polymers known in the art.

Suitable permanent wet strength agents include cationic oligomeric or polymeric resins. Polyamide-polyamine-epichlorohydrin type resins, such as KYMENE 557LX, KYMENE 6500, or KYMENE 613 sold by Hercules, Inc., located at Wilmington, Del., are the most widely used permanent wet-strength agents. Other cationic resins include polyethylenimine resins and aminoplast resins obtained by reaction of formaldehyde with melamine or urea. It is often advantageous to use both permanent and temporary wet strength resins in the manufacture of tissue products of this disclosure.

Suitable dry strength agents include, but are not limited to, modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. While such dry strength agents may be added to the sheets, such dry strength agents increase the strength of the sheet by increasing the amount of hydrogen bonding in the sheet and hence increasing the stiffness of the sheet. Due to the strength developed by the flexible polymeric binder, such dry strength agents are not usually required in the tissue sheets that comprise the polymeric flexible binder material.

In general, the present disclosure may be used in conjunction with any known materials and chemicals that are not antagonistic to its intended use. Examples of such materials and chemicals include, but are not limited to, odor control agents, such as odor absorbents, activated carbon fiber and particles, baby powder, baking soda, chelating agents, zeolites, perfumes or other odor-masking agents, cyclodextrin compounds, oxidizers, and the like. Superabsorbent particles, synthetic fiber, or films may also be employed. Other optional materials include cationic dyes, optical brighteners, absorbency aids and the like. In some applications, the tissue products of this disclosure may be treated with lotions and/or various other additives for numerous desired benefits. For example, formulations containing polysiloxanes may be topically applied to the tissue products in order to further increase the surface softness of the product. A variety of substituted and non-substituted polysiloxanes can be used.

Lotions can also be applied to the tissue products of this disclosure. Suitable lotions can be water-based or oil-based. Suitable water-based compositions include, but are not limited to, emulsions and water-dispersible compositions which can contain, for example, debonders (cationic, anionic or nonionic surfactants), or polyhydroxy compounds such as glycerin or propylene glycol. Oil-based lotions can contain, for instance, a mixture of an oil and a wax. For example, the composition may contain from about 30 to about 90 percent by weight oil and from about 10 to about 40 percent by weight wax. In some embodiments, a fatty alcohol may also be included in an amount from about 5 to about 40 percent by weight. Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, silicone fluids, silicone emulsions or mixtures thereof. For example, dimethicone and alkyl methyl silicones can be used. For example, various methods for silicone pre-treatment of fibers are disclosed in U.S. Pat. No. 6,964,725 to Shannon et al., U.S. Pat. No. 7,029,756 to Moline et al., and U.S. Pat. No. 7,147,752 to Shannon et al., which are all incorporated herein by reference. Suitable waxes include, but are not limited to, the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax or mixtures thereof. Suitable fatty alcohols include alcohols having a carbon chain length of from about 14 to about 30 carbon atoms, including acetyl alcohol, stearyl alcohol, behenyl alcohol, and dodecyl alcohol.

The application point for such materials and chemicals is not particularly relevant to the present disclosure and such materials and chemicals may be applied at any point in the tissue manufacturing process. This includes pre-treatment of pulp, co-application in the wet end of the process, post treatment after drying but on the tissue machine and topical post treatment.

The number of plies or webs of the products of this disclosure can be two, three, four, five or more. The layers that make up the various plies can be the same or different. For example, if a three layer ply is being made, the two outer layers can include hardwood fiber, post-consumer recycled fiber, or mixtures thereof and the center layer of the ply can include softwood fiber.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

The disclosure will be clarified by the following data, which is intended to be purely exemplary of the disclosure. In the experimental data provided below, some of the results have been obtained through certain embodiments of the present disclosure.

The Stiffness and Softness values in the tables are two separate values that come from the In-Hand Ranking (IHR) sensory panel as described herein. The twelve panelists are provided with six different tissue samples and are asked to rank them from the one that has the most softness (6), to the one with the least softness (1). Logistic regression converts these rankings into probability values, included in the below tables. Higher probability values indicate more softness. The probability values are then converted into the log-odds values shown in the second column of data. The log odds is calculated from the probability value using the equation: Log Odds=Log (Probability of a particular code/probability of the control code) using base 10 log.

For example, for the 10% trial code, the calculation of the log odds would be log (23.9/48.3)=−0.30. Higher log-odds softness values indicate higher softness.

The "stiffness" attribute is ranked and calculated in a similar manner. Stiffness is generally an undesirable attribute in tissue. Hence, high probability and log odds values for stiffness indicate more stiffness, which is less desired.

The softness and stiffness attributes have also been combined into one combined softness-stiffness, as shown in Table 3. This is calculated by using the softness log-odds value and subtracting the stiffness log-odds value for each sample. The stiffness log-odds are subtracted because higher stiffness values are not desired.

In the tables below, the control sample was produced in the same way as the trial samples, but it did not contain any post-consumer recycled fiber, only virgin fiber. The tables below illustrate that the samples that contained post-consumer recycled fiber were not statistically different in softness or stiffness when compared to the control sample.

The two samples in Tables 1-3 are commercially available facial tissue samples that are advertised to contain post-consumer recycled fiber. The first sample listed in the table is Green Forest facial tissue from Georgia Pacific. The second sample is "Seventh Generation" facial tissue. Both of these samples do not have softness and stiffness attributes that compare with samples of the present disclosure. Similar results are found in Tables 4-8.

Probability reported at 95% Cl for TABLES I-VIII.

TABLE I

| SOFTNESS | | LOGODDS |
|---|---|---|
| CONTROL | 48.3 | 0.0 |
| Trial 10% Post-Consumer RF | 23.9 | −0.3 |
| Trial 20% Post-Consumer RF | 16.7 | −0.5 |
| Trial 30% Post-Consumer RF | 10.8 | −0.7 |
| Green Forest | 0.2 | −2.4 |
| Seventh Generation | 0.0 | −6.7 |

TABLE II

| STIFFNESS | | LOGODDS |
|---|---|---|
| CONTROL | 0.6 | 0.0 |
| Trial 20% Post-Consumer RF | 0.7 | 0.1 |
| Trial 10% Post-Consumer RF | 1.3 | 0.3 |
| Trial 30% Post-Consumer RF | 4.1 | 0.8 |
| Green Forest | 13.9 | 1.4 |
| Seventh Generation | 79.4 | 2.1 |

TABLE III

| COMBINED SOFTNESS - STIFFNESS | | LOGODDS |
|---|---|---|
| CONTROL | 0.0 | 0.0 |
| Trial 20% Post-Consumer RF | 10.0 | −0.4 |
| Trial 10% Post-Consumer RF | 20.0 | −0.8 |
| Trial 30% Post-Consumer RF | 30.0 | −1.5 |
| Green Forest | 100.0 | −3.7 |
| Seventh Generation | 100.0 | −8.8 |

Figure 2:
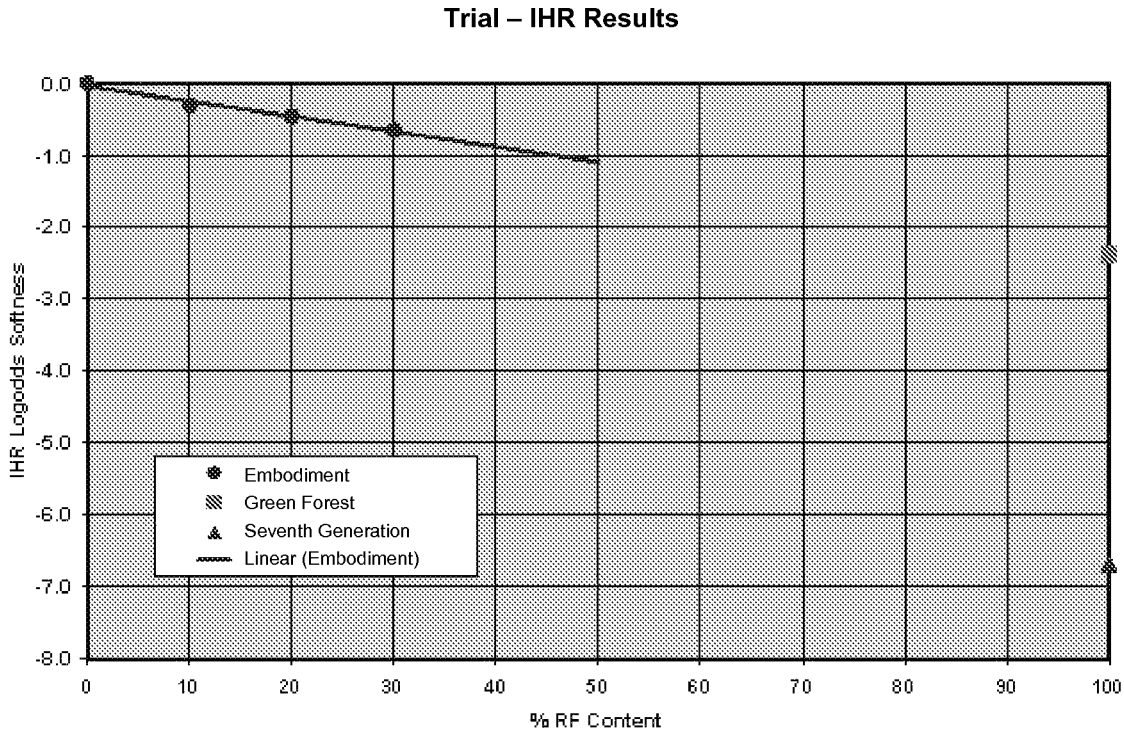
FIG. 2 is a plot of IHR logodds Softness versus % post-consumer recycled content in accordance with one embodiment of the present disclosure.

Certain results from TABLES I-III are plotted in FIGS. 1 and 2.

TABLE IV

| SOFTNESS | |
|---|---|
| CONTROL | 73.3 |
| Trial 30% Post-Consumer RF | 21.4 |
| Kleenex Mainline | 4.7 |
| Seventh Generation | 0.5 |
| Green Forest | 0.1 |
| SURPASS | 0.1 |

TABLE V

| STIFFNESS | |
|---|---|
| CONTROL | 48.0 |
| Trial 30% Post-Consumer RF | 32.9 |
| Kleenex Mainline | 8.7 |
| Seventh Generation | 6.1 |
| Green Forest | 2.6 |
| SURPASS | 1.7 |

TABLE VI

| SOFTNESS | |
|---|---|
| CONTROL | 42.6 |
| Trial 50% Post-Consumer RF | 15.4 |
| Trial 30% Post-Consumer RF | 15.0 |
| Trial 70% Post-Consumer RF | 10.4 |
| Trial 100% Post-Consumer RF | 5.6 |
| Trial 100% Post-Consumer RF Si Treated | 5.5 |
| Kleenex Mainline | 4.9 |
| Seventh Generation | 0.3 |
| Green Forest | 0.3 |
| SURPASS | 0.0 |

TABLE VII

| STIFFNESS | |
|---|---|
| CONTROL | 0.4 |
| Trial 50% Post-Consumer RF | 0.5 |
| Trial 30% Post-Consumer RF | 0.6 |
| Trial 70% Post-Consumer RF | 0.8 |
| Trial 100% Post-Consumer RF | 1.0 |
| Trial 100% Post-Consumer RF Si Treated | 2.3 |
| Kleenex Mainline | 5.5 |
| Seventh Generation | 14.3 |
| Green Forest | 28.3 |
| SURPASS | 46.4 |

TABLE VIII

| | CONTROL | | 10% POST-CONSUMER RF | | 20% POST-CONSUMER RF | | 30% POST-CONSUMER RF | |
|---|---|---|---|---|---|---|---|---|
| | Avg. | Std. | Avg. | Std. | Avg. | Std. | Avg. | Std. |
| Basis Weight - Bone Dry (#/2880 $ft^2$) | 15.27 | 0.13 | 15.44 | 0.19 | 15.06 | 0.15 | 15.62 | 0.10 |
| Basis Weight - Bone Dry ($g/m^2$) | 25.89 | 0.22 | 16.18 | 0.32 | 25.53 | 0.26 | 26.48 | 0.17 |

TABLE VIII-continued

| | CONTROL | | 10% POST-CONSUMER RF | | 20% POST-CONSUMER RF | | 30% POST-CONSUMER RF | |
|---|---|---|---|---|---|---|---|---|
| | Avg. | Std. | Avg. | Std. | Avg. | Std. | Avg. | Std. |
| Basis Weight - Conditioned (#/2880 ft2) | 16.49 | 0.13 | 16.59 | 0.20 | 16.31 | 0.22 | 16.74 | 0.11 |
| Basis Weight - Conditioned ($g/m^2$) | 27.96 | 0.22 | 28.13 | 0.33 | 27.65 | 0.38 | 28.38 | 0.19 |
| Caliper, 1 sheet (um) | 152 | 5 | 174 | 4 | 172 | 4 | 169 | 3 |
| Caliper, 10 sheet (um/sheet) | 161 | 2 | 177 | 4 | 174 | 2 | 174 | 2 |
| Stack Bulk ($cm^3/g$) | 5.75 | 0.11 | 6.29 | 0.2 | 6.29 | 0.1 | 6.13 | 0.05 |
| GMT (g) | 696.9 | | 660.8 | | 712.8 | | 775.6 | |
| MD/CD Ratio | 2.13 | | 2.18 | | 2.22 | | 2.07 | |
| GM TEA (g-cm/cm2) | 5.02 | | 5.18 | | 5.65 | | 6.18 | |
| GMM - Slope (kg) | 11.38 | | 9.47 | | 9.56 | | 11.02 | |
| Wet/Dry Tensile CD (%) | 29.5% | | 27.0% | | 21.1% | | 19.8% | |
| MD Tensile (g/3 in) | 1016 | 72 | 976.37 | 71.68 | 1062.71 | 103.29 | 1117.04 | 58.23 |
| MD Stretch (%) | 11.4 | 0.6 | 14 | 0.82 | 14.77 | 1.1 | 14.6 | 0.6 |
| MD TEA (g-cm/$cm^2$) | 9.21 | 0.78 | 10.35 | 1.08 | 11.46 | 1.21 | 12.03 | 0.7 |
| MD Slope (kg) (70-157) | 9.66 | 0.9 | 7.31 | 0.44 | 7.18 | 0.4 | 8.03 | 0.5 |
| CD Tensile (g/3 in) | 478 | 39 | 447.29 | 21.86 | 478.04 | 44.54 | 538.52 | 23.78 |
| CD Stretch (%) | 4.5 | 0.4 | 4.62 | 0.32 | 4.61 | 0.4 | 4.6 | 0.42 |
| CD TEA (g-cm/$cm^2$) | 2.74 | 0.37 | 2.592 | 0.229 | 2.788 | 0.32 | 3.175 | 0.426 |
| CD Slope (kg) (70-157) | 13.4 | 1.56 | 12.27 | 1.04 | 12.72 | 2.1 | 15.11 | 0.93 |
| CD Wet Tensile (g/3 in) | 141 | 29 | 120.67 | 22.8 | 101.1 | 17.5 | 106.88 | 21.18 |
| Crimp Strength | 19 | 9.8 | 30.2 | 12.5 | 35.7 | 13.7 | 41.3 | 26.2 |
| Brightness (%) | 89.5 | 0.08 | 88.46 | 0.09 | 87.4 | 0.16 | 86.74 | 0.07 |
| Color L, TB-1C | 97.11 | 0.03 | 96.21 | 0.03 | 95.62 | 0.04 | 95.19 | 0.04 |
| Color a, TB-1C | −0.36 | 0.07 | −0.28 | 0.05 | −0.21 | 0.03 | −0.15 | 0.06 |
| Color b, TB-1C | 3.51 | 0.05 | 3.01 | 0.06 | 2.97 | 0.07 | 2.9 | 0.08 |
| Absorbent Capacity - 3" × 3" (g) | 32.53 | 1.56 | 32.05 | 0.62 | 31.86 | 0.81 | 31.64 | 0.71 |
| Abs Cap/Spec Cap - 3" × 3" (g/g) | 9.32 | 0.04 | 9.45 | 0.16 | 9.45 | 0.23 | 9.13 | 0.13 |
| Absorbent Wet-out Time (sec) | 3.2 | 0.04 | 2.8 | 0.2 | 2.9 | 0 | 2.8 | 0.01 |
| Formation Index | 151 | | 156 | | 153 | | 150 | |
| Average Contrast Intensity (CI) | 8.77 | 0.34 | 8.71 | 0.4 | 8.76 | 0.32 | 8.99 | 0.35 |
| Sheet Length (mm) | 216 | 1 | 215 | 0 | 214 | 0 | 214 | 0 |
| Sheet Width (mm) | 213 | 1 | 212 | 2 | 211 | 1 | 212 | 1 |

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the disclosure so further described in such appended claims.

What is claimed is:

1. A multiple ply tissue product comprising:
a first ply comprising
a first outwardly facing layer having hardwood fibers present in an amount of from about 30 percent to about 50 percent by weight,
a second layer having softwood fibers, and
a third layer having at least about 30 percent by weight post-consumer recycled fiber, wherein said second layer is positioned between said first layer and said third layer; and
a second ply, wherein the second ply is positioned adjacent to the third layer of the first ply; and wherein said multiple ply tissue product has a crimp strength from about 20 grams to about 40 grams.

2. A multiple ply tissue product as in claim 1, wherein said hardwood fibers comprise eucalyptus fibers.

3. A multiple ply tissue product as in claim 2, wherein said hardwood fibers further comprise eucalyptus fibers pretreated with silicone.

4. A multiple ply tissue product as in claim 1, wherein said softwood fibers comprise northern softwood kraft fibers.

5. A multiple ply tissue product as in claim 1, wherein said softwood fibers are present in said first layer in an amount from about 20 percent to about 40 percent by weight.

6. A multiple ply tissue product as in claim 1, wherein said second ply comprises:
a first outwardly facing layer having hardwood fibers,
a second layer having softwood fibers, and
a third layer having at least about 10 percent by weight post-consumer recycled fiber, wherein said second layer of said second ply is positioned between said first layer of said second ply and said third layer of said second ply and said third layer of said second ply is positioned adjacent to said third layer of said first ply.

7. A multiple ply tissue product as in claim 1, wherein said first ply and said second ply are joined together by mechanical crimping.

8. A multiple ply tissue product comprising:
a first ply comprising
a first outwardly facing layer having hardwood fibers present in an amount of from about 30 percent to about 50 percent by weight,
a second layer having softwood fibers, and
a third layer having at least about 30 percent by weight post-consumer recycled fiber, wherein said second layer is positioned between said first layer and said third layer; and
a second ply comprising
a first layer having hardwood fibers,
a second layer having softwood fibers, and
a third layer having at least about 10 percent by weight post-consumer recycled fiber, wherein said second layer of said second ply is positioned between said first layer of said second ply and said third layer of said second ply and said third layer of said second ply is positioned adjacent to said third layer of said first ply; and wherein said multiple ply tissue product has a crimp strength from about 20 grams to about 40 grams.

9. A multiple ply tissue product as in claim 8, wherein said hardwood fibers comprise eucalyptus fibers.

10. A multiple ply tissue product as in claim 9, wherein said hardwood fibers further comprise eucalyptus fibers pretreated with silicone.

11. A multiple ply tissue product as in claim 8, wherein said softwood fibers comprise northern softwood kraft fibers.

12. A multiple ply tissue product as in claim 8, wherein said first layer of said second ply is outwardly facing.

13. A multiple ply tissue product as in claim 8, further comprising a third ply, said third ply comprising:
a first outwardly facing layer having hardwood fibers,
a second layer having softwood fibers, and
a third layer having at least about 10 percent by weight post-consumer recycled fiber, wherein said second layer of said third ply is positioned between said first layer of said third ply and said third layer of said third ply and said third ply is positioned adjacent to the second ply.

14. A multiple ply tissue product as in claim 8, wherein said first ply and said second ply are joined together by mechanical crimping.

15. A multiple ply tissue product as in claim 8, said product having a crimp strength of at least about 20 grams.

16. A multiple ply tissue product as in claim 8, said product having a crimp strength of at least about 30 grams.

17. A multiple ply tissue product as in claim 8, said product having a crimp strength of at least about 40 grams.

* * * * *

UNITED STATES PATENT AND TRADEMARK OFFICE

CERTIFICATE OF CORRECTION

PATENT NO. : 8,414,738 B2
APPLICATION NO. : 11/847440
DATED : April 9, 2013
INVENTOR(S) : Rekoske et al.

It is certified that error appears in the above-identified patent and that said Letters Patent is hereby corrected as shown below:

Title page, col. 2, under FOREIGN PATENT DOCUMENTS, delete "GB 294480 A" and insert

--GB 2294480 A--.

Signed and Sealed this
Seventh Day of January, 2014

Margaret A. Focarino

Margaret A. Focarino
*Commissioner for Patents of the United States Patent and Trademark Office*